US006026270A

United States Patent [19]

Okiyama et al.

[11] Patent Number: 6,026,270

[45] Date of Patent: Feb. 15, 2000

[54] MEDIUM TRANSPORTING APPARATUS HAVING ATTRACTION MEMBER

[75] Inventors: Yoshitatsu Okiyama; Ken Kikuchi; Fumiaki Yoshida, all of Tokyo, Japan

[73] Assignee: Oki Data Corporation, Tokyo, Japan

[21] Appl. No.: 09/313,136

[22] Filed: May 17, 1999

[30] Foreign Application Priority Data

May 19, 1998 [JP] Japan ..... 10-136213

[51] Int. Cl.[7] ..... G03G 15/01

[52] U.S. Cl. ..... 399/303; 198/691

[58] Field of Search ..... 399/303, 312, 399/316; 198/691; 271/275, 198

[56] References Cited

U.S. PATENT DOCUMENTS

| | | | |
|---|---|---|---|
| 4,912,516 | 3/1990 | Kaieda | 399/312 |
| 5,132,737 | 7/1992 | Takeda et al. | 399/303 |
| 5,249,023 | 9/1993 | Miyashiro et al. | 399/303 |
| 5,291,253 | 3/1994 | Kumasaka et al. | 399/66 |
| 5,794,110 | 8/1998 | Kasai et al. | 399/299 |
| 5,873,016 | 2/1999 | Kurokawa et al. | 399/297 |

*Primary Examiner*—Robert Beatty

*Attorney, Agent, or Firm*—Akin, Gump, Strauss, Hauer & Feld, L.L.P.

[57] ABSTRACT

A medium-transporting apparatus has a carrier belt which carries a medium attracted thereto. An attraction roller is disposed in an abutting relation with the carrier belt. The print medium is sandwiched and passes between the attraction roller and the carrier belt. The attraction roller has a low resistance resilient roller and a high resistance member of an insulating material or a semiconductive material formed on the surface of the resilient roller. The member has a higher electrical resistance than the print medium and prevents current from flowing through areas in which the print medium is absent between the attraction roller and the carrier belt. The attraction roller receives a high voltage so that a discharge occurs between the attraction roller and the print medium when the print medium separates from the attraction roller as the print medium passes between the attraction roller and the carrier belt, thereby depositing charges on the print medium so that the print medium is electrostatically attracted to the carrier belt.

6 Claims, 6 Drawing Sheets

MEDIUM TRANSPORTING APPARATUS HAVING ATTRACTION MEMBER

BACKGROUND OF THE INVENTION

The present invention relates to a medium-transporting apparatus.

With conventional tandem type image-forming apparatuses such as a color electrophotographic printer, a print medium passes through image-forming sections for corresponding colors. A print medium is advanced by a medium pick up roller from a print medium cassette, and fed by feed rollers to transport rollers. The transport rollers transport the print medium to a carrier belt and the print medium is attracted by the Coulomb force to the carrier belt. The image-forming sections for yellow, magenta, cyan, and black images face the carrier and are disposed along the carrier belt. Toner images of corresponding colors are transferred in registration with one another from the photoconductive drums of the respective image-forming sections. The print medium is then separated from the carrier belt and directed to a fixing unit where the colored toner images are fixed into a full color image.

In order for the carrier belt to attract the print medium, a voltage is applied across an attraction roller and an idle roller that opposes the attraction roller. When the print medium passes an attraction region between the attraction roller and the carrier belt, the print medium on the carrier belt is charged. A current flows through the print medium that functions as a capacitance component. This capacitance component stores the Coulomb force that attracts the print medium to the carrier belt.

The attraction roller longitudinally extends over a length longer than the width of the print medium.

When the width of a print medium is shorter than the length of the attraction roller, the attraction region has an area in direct contact with the carrier belt and areas in which the print medium is sandwiched between the attraction roller and the carrier belt. If the print medium has a higher resistance than the attraction roller, a larger current flows through the areas of the attraction roller in direct contact with the carrier belt than through the areas in which the print medium is sandwiched between the carrier belt to the attraction roller.

Therefore, a sufficient voltage cannot be applied across the thickness of the print medium with the result that the print medium is not sufficiently attracted to the carrier belt. To overcome this drawback, the electrical resistance of the attraction roller can be made higher than that of the print medium.

However, increasing the electrical resistance of the attraction roller results in larger voltage drops across the attraction roller. The large voltage drops across the attraction roller necessitates a higher output voltage of a power supply to ensure that a sufficiently high voltage is applied across the thickness of the print medium.

SUMMARY OF THE INVENTION

The present invention was made to solve the aforementioned drawbacks of the conventional medium-transporting device.

An object of the present invention is to provide a medium-transporting device where a carrier belt sufficiently attracts a print medium using as low a voltage across an attraction roller as possible.

Another object of the invention is to provide an efficient medium-transporting device.

A medium-transporting apparatus transports a transport member or carrier belt on which a medium is attracted. An attraction member or attraction roller is disposed in an abutting relation with the transporting member, so that the print medium is sandwiched between the attraction roller and the carrier belt. The attraction roller causes the medium to be electrostatically attracted to the carrier belt when the print medium passes between the attraction roller and the carrier belt. A current preventing member is provided on a surface of the attraction roller in contact with the carrier belt. The current preventing member has a higher electrical resistance than the print medium. A neutralizing member may be disposed to oppose the insulating member in order to neutralize the surface of the insulating member.

The current preventing member is, for example, an insulating member provided on the electrically conductive member.

The current preventing member may a semiconductive member provided on the electrically conductive member, the semiconductive member having a volume resistivity higher than $5\times10^{11}$ Ω.cm.

The current preventing member may be a semiconductive member provided on the electrically conductive member, the semiconductive member having ion conduction and a volume resistivity higher than $5\times10^{11}$ Ω.cm.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE SEVERAL VIEWS OF THE DRAWINGS

The present invention will become more fully understood from the detailed description given hereinbelow and the accompanying drawings which are given by way of illustration only, and thus are not limitative of the present invention, and wherein.

DESCRIPTION OF THE INVENTION

Preferred embodiments of the present invention will be described in detail with reference to the accompanying drawings.

First Embodiment

Construction

Figure 1:
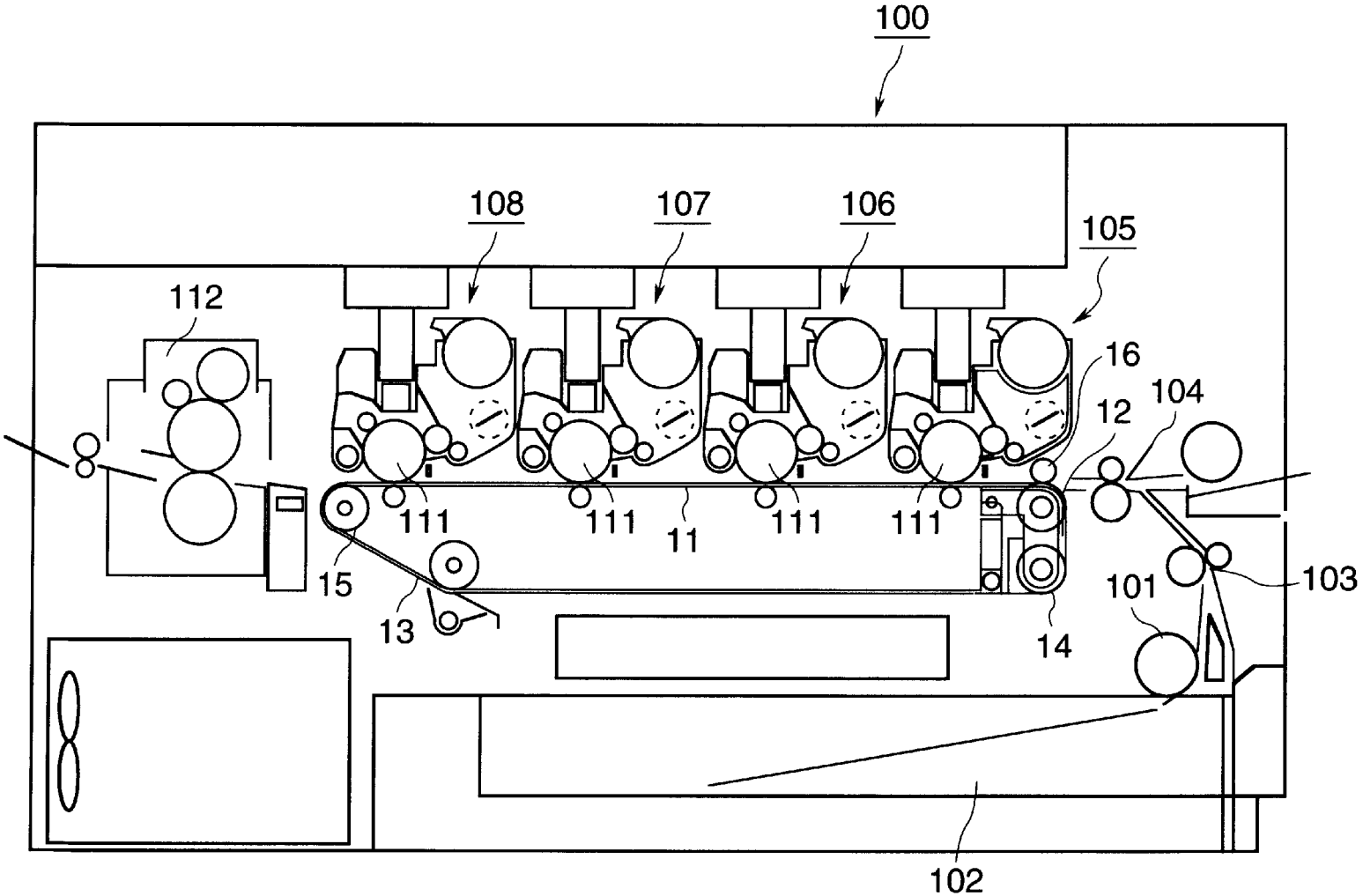
FIG. 1 illustrates a general construction of an electrophotographic printer to which the present invention is applied.

FIG. 1 illustrates a general construction of an electrophotographic printer to which the present invention is applied.

Figure 2:
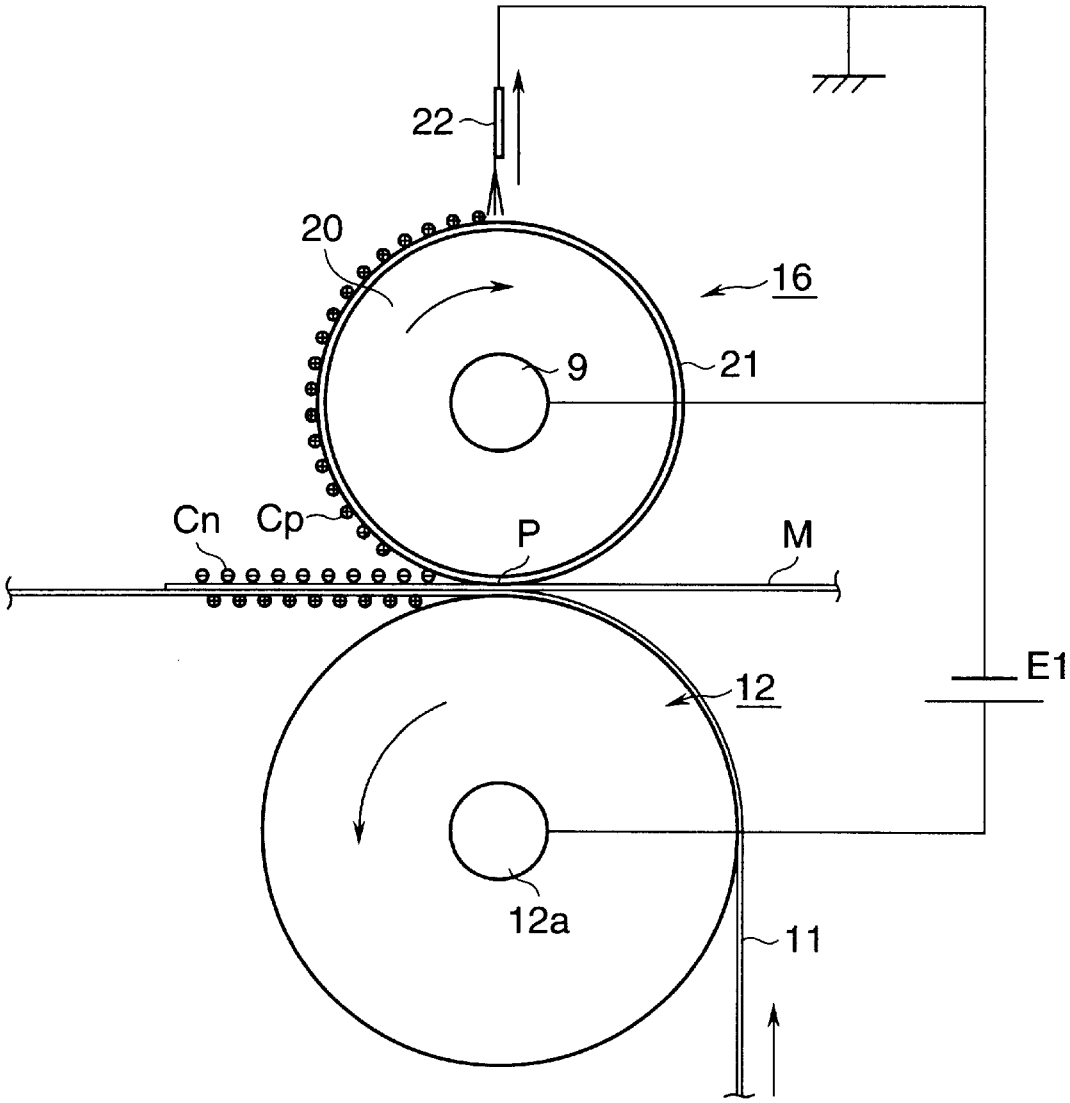
FIG. 2 is a transverse cross-sectional view of a print medium transporting apparatus according to a first embodiment.

FIG. 2 is a transverse cross-sectional view of a medium-transporting apparatus according to a first embodiment.

Referring to FIG. 1, an image-forming apparatus 100 is of a tandem type electrophotographic printer. A print medium M is advanced by a medium pick up roller 101 from a medium cassette 102 and then fed into a feeding path. Transport rollers 104 then advance the print medium M to a carrier belt 11 to which the print medium M is electrostatically attracted. The image-forming sections 105–108 for yellow, magenta, cyan, and black images face the carrier belt 11 and are aligned along the carrier belt 11 in this order. As the print medium M passes the respective image-forming sections, images of corresponding colors are transferred to the print medium M in registration with one another. Thereafter, the print medium M is separated from the carrier belt 11 and fed to the fixing unit 112. The toner images of the respective colors on the print medium M is fixed by the fixing unit 112 into a full color image.

The carrier belt 11 is mounted about idle rollers 12 and 13, and a drive roller 15, and held taut by a tension roller 14. When the drive roller 15 is driven in rotation by a drive source, not shown, the idle rollers 12 and 13 and tension roller 14 rotate so that the carrier belt 11 runs.

Figure 3:
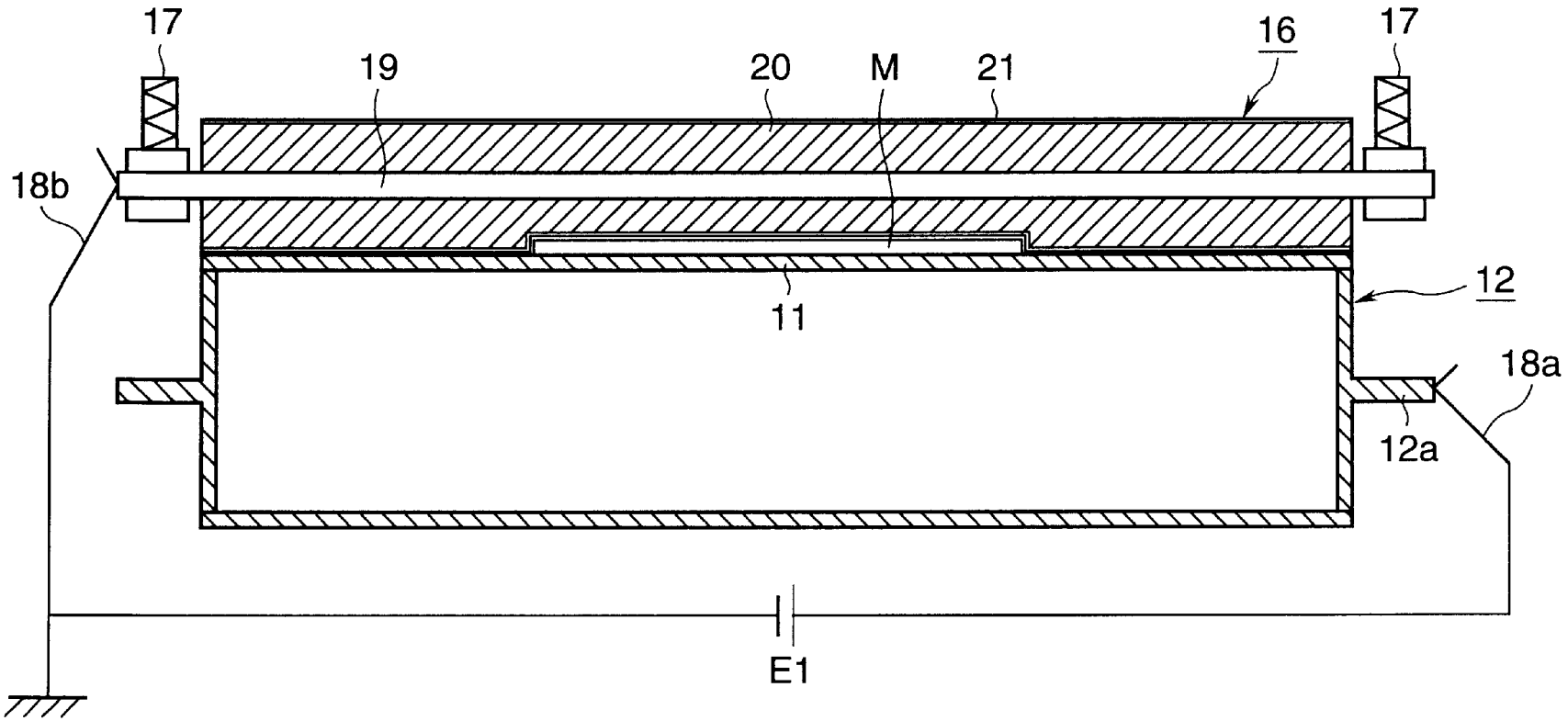
FIG. 3 is a longitudinal cross-sectional view of the print medium-transporting apparatus of the first embodiment.

FIG. 3 is a longitudinal-sectional view of the medium-transporting apparatus.

An attraction roller 16 opposes the idle roller 12 with the carrier belt 11 sandwiched between the attraction roller 16 and idle roller 12. The attraction roller 16 is urged against the idle roller 12 by an urging spring 17, so that the attraction roller 16 is in abutting relation with the carrier belt 11. The attraction roller 16 includes a core metal 19, a semiconductive resilient member 20 that is formed around the core metal 19, and a very thin insulating member 21 that covers the circumferential surface of the resilient member 20. The insulating member 21 is, for example, in the shape of a hollow cylinder having a very thin wall.

A contact 18*a* is in electrical contact with one end of a shaft 12*a* of the idle roller 12. A contact 18*b* is in electrical contact with one end of the core metal 19 of the attraction roller 16. A power supply E1 is connected across the contacts 18*a* and 18*b* to apply a voltage thereacross. The contact 18*b* and a negative polarity of the power supply E1 are grounded.

Referring back to FIG. 2, a neutralizing member 22 is disposed on the surface of the attraction roller 16 remote from the idle roller 12. The neutralizing member 22 is grounded so that the insulating member 21 is neutralized. The carrier belt 11 runs at a speed of 50 mm/s (equivalent to 8 page per minute). The power supply supplies a current larger than 1$\mu$A to the attraction roller 16. The current larger than 1$\mu$A is required to flow through the print medium M for the print medium M to be sufficiently attracted to the carrier belt 11. If, for example, the insulating member 21 has a relative dielectric constant $\epsilon$ of 15 (usually$\epsilon$=2 to 15) and a thickness of less than 0.7 mm, and functions as a sufficient capacitance component.

In the embodiment, the insulating member 21 has a thickness of 0.5 mm. An area of the surface of the print medium M remains in contact with the attraction roller 16 for 0.12 second (6 mm/50 mm/s=0.12s), assuming that the attraction roller 16 has a diameter of 30 mm, the width of the nip is 6 mm (depth of a nip of the attraction roller is 0.3 mm), and the print medium M travels at a speed of 50 mm/s. Thus, a capacitor formed of the insulating member 21 needs to be charged in less than 0.12 second. For this purpose, if the insulating member 21 has a relative dielectric constant $\epsilon$ of, for example, 2 and a voltage higher than 500 V is applied across the insulating member 21 and the print medium M, the resistance of the resilient member 20 should be less than $3\times10^8\ \Omega$ so that the capacitance of the insulating member 21 is charged up to at least 500 V in less than 0.12 second. The voltage of 500 V is a minimum voltage required for a discharge to occur between the attraction roller 16 and the print medium M when the print medium M is separated from the attraction roller 16 as the print medium M passes the attraction region P.

Operation

The operation of the medium-transporting apparatus of the aforementioned construction will now be described.

In the present invention, a discharge occurs between the print medium M and the attraction roller 16 when the print medium M separates from the attraction roller and the print medium M acquires Coulomb force due to the discharge. Thus, the present invention differs from the conventional art where a current flows through the print medium M and the print medium M acquires Coulomb force due to the current that flows through the print medium.

When the image-forming section apparatus 100 receives a print-initiating signal from a host apparatus, not shown, the medium pick up roller 101 is driven into rotation by the drive source, not shown, and the print medium M is advanced from the medium cassette 102. Then, when a detector, not shown, detects the medium M, the feed roller 103 feeds the print medium M to the transport rollers 104.

Then, the transport rollers 104 are driven into rotation by the drive source to transport the print medium M, so that the leading end of the print medium M reaches one end of the transport belt 11, i.e., an attraction region P1 between the carrier belt 11 and the attraction roller 16. The power supply E1 applies a voltage of about 2 kV across the idle 12 and the attractive roller 16. Although the insulating member 21 formed on the peripheral surface of the attraction roller 16 is subjected to an electric field, little or no current flows through the insulating member 21 directly from the carrier belt 11 to the attraction roller 16.

Thus, a voltage high enough for the transport belt to attract the print medium M thereto is applied across the thickness of the print medium M.

When the print medium M leaves the attraction region P1, a discharge occurs between the insulating member 21 and the print medium M. As a result, negative charges Cn are deposited on the print medium M and positive charges Cp are deposited on the insulating member 21. The idle roller 12 deposits charges on the inside of the carrier belt 11. Thus, the print medium M is electrostatically attracted to the carrier belt 11.

The insulating member 21 is positively charged and is subsequently neutralized to 0 volts by the neutralizing member 22, so that the surface of insulating member 21 no longer remains charged after the surface has passed the neutralizing member 22. The discharge is constantly maintained between the insulating member 21 and the print medium M at the attraction region P1, so that negative charges Cn are constantly deposited on the print medium M and positive charges Cp are deposited on the insulating member 21.

As shown in FIG. 3, when the print medium M has a width shorter than the length of the attraction roller 16, some areas of the surface of the attraction roller 16 are in direct contact with the carrier belt 11, i.e., the print medium M is absent between the attraction roller 16 and idle roller 12. Since the insulating member 21 formed on the surface of the attraction roller 16 is very thin, a high electric field is developed across the width of the insulating member 21. Little or no current flows through the insulating member 21 and therefore a sufficient voltage is applied across the thickness of the insulating member 21. Thus, a difference in potential between the insulating member 21 and the print member M is created so that the print medium M is attracted to the carrier belt 11. When the print medium M leaves the attraction region P, a stable discharge occurs between the insulating member 21 and the print medium M, ensuring that the print medium M is attracted to the carrier belt 11.

As mentioned above, the insulating member 21 formed on the surface of the attraction roller 16 has a high electrical resistance and prevents current from flowing therethrough. Thus, even if the resilient member 20 has a low electrical resistance, a significant amount of current will not flow from the idle roller 12 to the attraction roller 16 through the surface of the insulating member 21 in direct contact with the carrier belt 11. Thus, a sufficient voltage can be applied across the thickness of the print medium M irrespective of the electrical resistance and width of the print medium M.

The low resistance of the resilient member 20 allows lowering of the output voltage of the power supply E1, improving the efficiency of the medium-transporting apparatus. If the insulating member 21 is formed of, for example, a plastic film, the attraction roller 16 can be easily cleaned.

Second Embodiment

Construction

Elements of the same construction as those in the first embodiment have been given the same reference numerals and description thereof is omitted.

Figure 4:
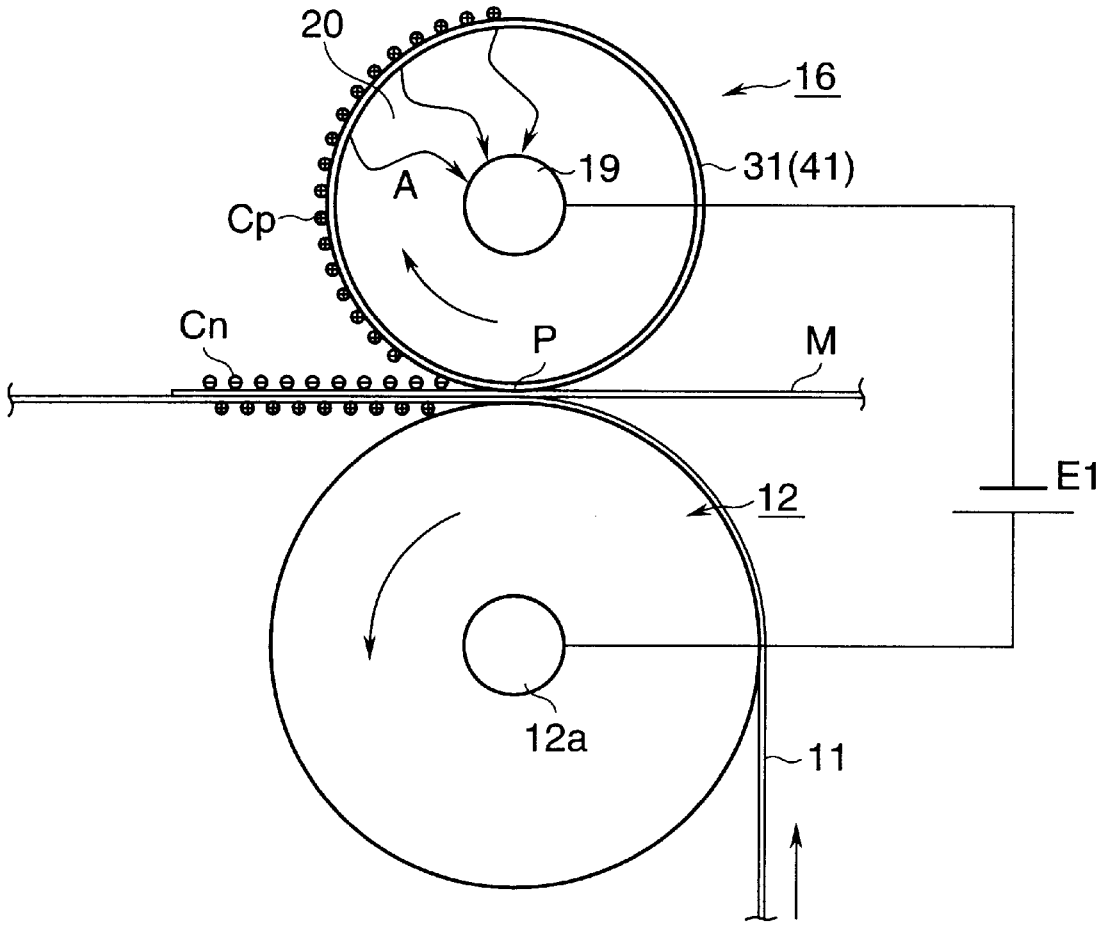
FIG. 4 is a transverse cross-sectional view of a medium-transporting apparatus of a second embodiment and a third embodiment.

FIG. 4 is a transverse cross-sectional view of a medium-transporting apparatus of a second embodiment.

The second embodiment differs from the first embodiment in that the semiconductive resilient member 20 is covered with a semiconductive member 31 instead of the insulating member 21. The semiconductive member 31 has a higher resistance than the print medium M and takes the form of a hollow cylinder having a very thin wall.

The carrier belt 11 runs at a speed of 50 mm/s (equivalent to 8 page per minute). The power supply supplies a current larger than 1 $\mu$A to the attraction roller 16. The current larger than 1 $\mu$A is required to flow through the print medium M for the print medium M to be sufficiently attracted to the carrier belt 11. If, for example, the semiconductive member 41 has a relative dielectric constant $\epsilon$ of 15 (usually $\epsilon$=2 to 15) and the semiconductive member 41 has thickness of less than 0.7 mm, the semiconductive member 41 functions as a sufficient capacitance component. In the embodiment, the semiconductive member 41 takes the form of a hollow cylinder having a wall.

An area of the surface of the print medium M stays in contact with the attraction roller 16 for 0.12 second (6 mm/50 mm/s=0.12 s), assuming that the attraction roller 16 has a diameter of 30 mm, the width of the nip is 6 mm (depth of a nip of the attraction roller is 0.3 mm), and the print medium M travels at a speed of 50 mm/s. Thus, a capacitor formed of the semiconductive member 31 needs to be charged in less than 0.12 second. For this purpose, if the semiconductive member 31 has a relative dielectric constant $\epsilon$ of, for example, 2 and a voltage higher than 500 V is applied across the semiconductive member 31 and the print medium M, the resistance of the resilient member 20 should be less than $3\times10^8$ Ω so that the capacitance of the semiconductive member 31 is charged up to at least 500 V in less than 0.12 second. The voltage of 500 V is a minimum voltage required for a discharge to occur between the attraction roller 16 and the print medium M when the print medium M is separated from the attraction roller 16 as the print medium M passes the attraction region P.

The typical volume resistivity of the print medium M is about $1\times10^{11}$ Ω.cm. In order that little or no current flows from the idle roller 12 to the attraction roller 16 through an area where the print medium M is absent between the attraction roller 16 and the carrier belt 11, the resistance of the semiconductive member 31 needs to be about 5 times that of the print medium M. In the second embodiment, the volume resistivity of the semiconductive member 31 is selected to be $5\times10^{11}$ Ω.cm.

Operation

The operation of the medium-transporting apparatus of the second embodiment will now be described. Just as in the first embodiment, the print medium M is fed to the attraction region P between the carrier belt 11 and the attraction roller 16. The power supply E1 applies a voltage of about 2 kV across the attraction roller 16 and the idle roller 12.

The semiconductive member 31 is charged to a positive polarity. Since the semiconductive member 31 is thin, the electric field developed across the thickness of the semiconductive member 31 is high so that electrons can easily migrate through the semiconductive member 31 and resilient member 20. Thus, a current flows in directions shown by arrows A from the semiconductive member 31 to the core metal 19 before the charged surface of the attraction roller 16 rotates back to the attraction region P1, thereby neutralizing the surface of the semiconductive member 31.

A discharge constantly occurs between the semiconductive member 31 and the print medium M at the attraction region P, so that negative charges Cn are deposited on the print medium M and positive charges Cp are deposited on the semiconductive member 31. Thus, the print medium M is continuously attracted to the carrier belt 11.

If the print medium M has a narrow width, the attraction roller 16 has some areas in direct contact with the carrier belt 11, i.e., the print medium M is absent between the attraction roller 16 and the carrier belt 11.

Figure 5:
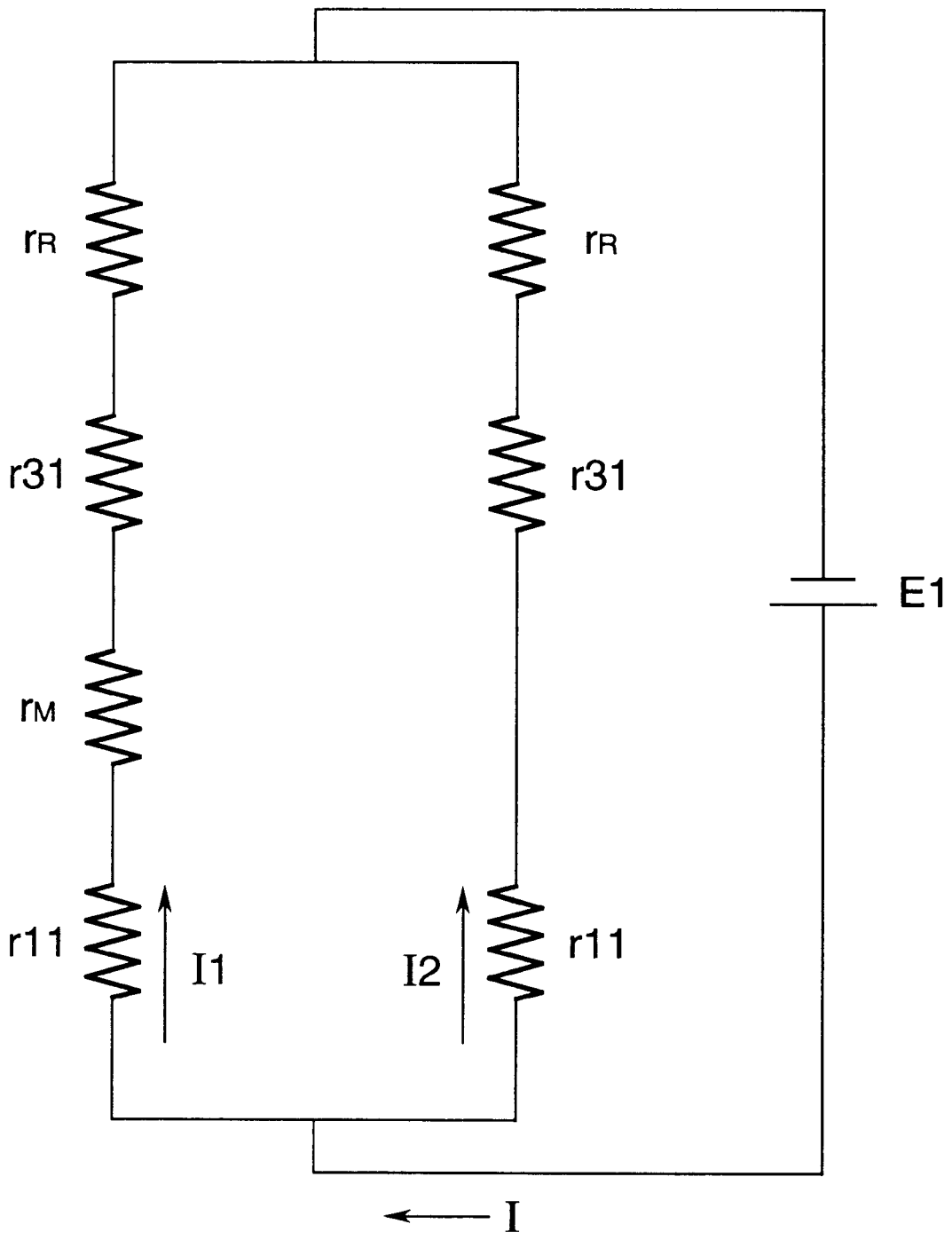
FIG. 5 shows an electrical equivalent circuit of the medium-transporting apparatus of the second embodiment.

FIG. 5 shows an electrical equivalent circuit of the medium-transporting apparatus of the second embodiment.

The equivalent circuit is a parallel connection of a series circuit of r11 (carrier belt 11), $r_M$ (print medium M), r31 (semiconductive member 31), and $r_R$ (idle roller 12 and resilient member 20), and a series circuit of r11 (carrier belt 11), r31 (semiconductive member 31), and $r_R$ (idle roller 12 plus resilient member 20). Thus, the resistance r31 of the semiconductive member 31 limits the current I2 through the contact area between the semiconductive member 31 and carrier belt 11.

The difference between the output voltage of the power supply E1 and the sum of the voltage drops across $r_R$, $r_M$, and r11 appears across the semiconductive member 31, thereby creating a potential difference between the thin semiconductive member 31 and the print medium M. This stabilizes the discharge between the semiconductive member 31 and the print medium M, ensuring that the print medium M is attracted to the carrier belt 11.

The resultant resistances R1 and R2 of the two series circuits are as follows:

$$R1=r11+r_M+r31+r_R$$

$$R2=r11+r31+r_R$$

The r31 is selected to be five times as high as $r_M$. The r11 and $r_R$ are much lower than resistance $r_M$. Therefore, the values of R1 and R2 primarily depend on the value of r31, and the difference between R1 and R2 is small. The voltage across the thickness of the print medium M is rather small.

In this manner, the semiconductive member 31 formed on the surface of the attraction roller 16 can limit the amount of current that flows directly from the idle roller 12 to the attraction roller 16. Even if the print medium M is absent from some areas between the attraction roller 12 and the carrier belt 11, a sufficient voltage can be applied across the thickness of the print medium M so that the print medium M is sufficiently attracted to the carrier belt 11.

Since the resistance of the resilient member 20 need not be high, the voltage drop across the resilient member 20 is low. This allows a sufficiently high voltage to appear across the thickness of the print medium M. Thus, the output voltage of the power supply E1 can be lowered for increased efficiency of the medium-transporting device. If the insulating member 31 is formed of, for example, a plastic film, the attraction roller 16 can be easily cleaned.

Third Embodiment

Construction

Elements similar to those of the first embodiment have been given the same reference numerals and description thereof is omitted. A third embodiment differs from the second embodiment in that a semiconductive member 41 is used in place of the semiconductive member 41. Thus, the third embodiment is described with reference to FIG. 4.

Figure 6:
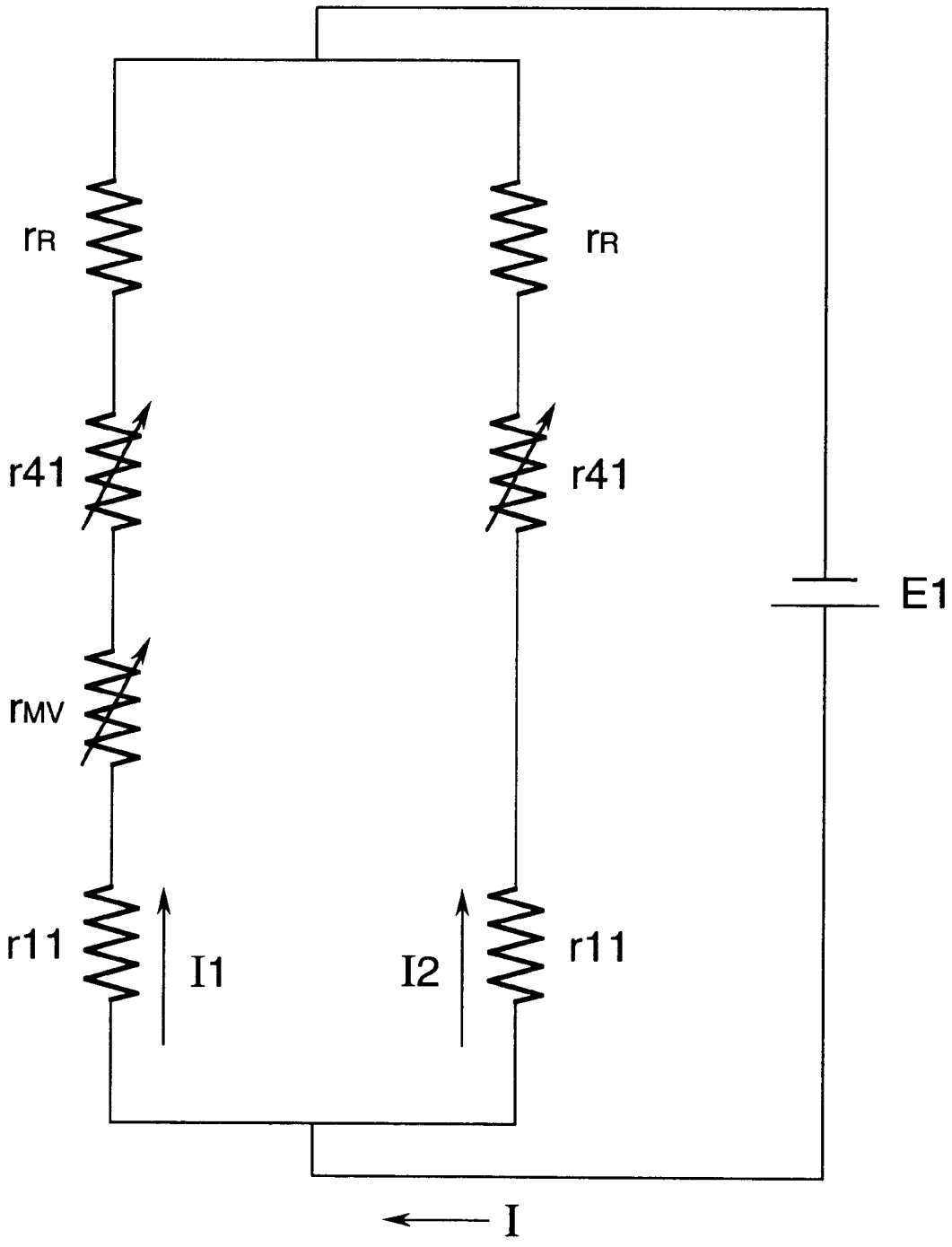
FIG. 6 is an electrical equivalent circuit of the third embodiment.

FIG. 6 is an electrical equivalent circuit of the third embodiment.

The surface of the resilient member 20 is covered with a thin semiconductive member 41 having an electrical resistance, which is higher than that of the print medium M and humidity dependent, i.e., the semiconductive member 41 has ionic conduction. The semiconductive member 41 is made of a material whose resistance decreases with increasing humidity and increases with decreasing humidity, e.g., a resin such as PVDF and PA, or a rubber material such as urethane.

The carrier belt 11 runs at a speed of 50 mm/s (equivalent to 8 page per minute). The power supply supplies a current larger than 1 $\mu$A to the attraction roller 16. The current larger than 1 $\mu$A is required to flow through the print medium M for the print medium M to be sufficiently attracted to the carrier belt 11. If, for example, the semiconductive member 41 has a relative dielectric constant $\epsilon$ of 15 (usually $\epsilon$=2 to 15) and the semiconductive member 41 has a thickness of less than 0.7 mm, the insulating member 41 functions as a sufficient capacitance component.

In the embodiment, the semiconductive member 41 has a thickness of 0.5 mm. An area of the surface of the print medium M stays in contact with the attraction roller 16 for 0.12 second (6 mm/50 mm/s=0.12 s), assuming that the attraction roller 16 has a diameter of 30 mm, the width of the nip is 6 mm (depth of a nip of the attraction roller is 0.3 mm), and the print medium M travels at a speed of 50 mm/s. The carrier belt 11 runs at a speed of 50 mm/s (i.e., 8 page per minute) and it takes 0.12 second for a part of the print medium M in contact with the attraction roller 16 to pass the attraction region between the attraction roller 16 and the print medium M. Thus, a capacitor formed of the semiconductive member 41 needs to be charged in less than 0.12 second. For this purpose, if the semiconductive member 41 has a relative dielectric constant $\epsilon$ of, for example, 2 and a voltage higher than 500 V is applied across the semiconductive member 41 and the print medium M, the resistance of the resilient member 20 is selected to be less than $3\times10^8$ $\Omega$ so that the capacitance of the semiconductive member 41 is charged up to at least 500 V in less than 0.12 second. The voltage of 500 V is a minimum voltage required for a discharge to occur between the attraction roller 16 and the print medium M when the print medium M is separated from the attraction roller 16 as the print medium M passes the attraction region P.

The typical volume resistivity of a print medium M is about $1\times10^{11}$ $\Omega$.cm at room temperature. In order that little or no current flows through areas of the surface of the attraction roller 16 which is not in contact with the print medium M, the resistance of the semiconductive member 41 should be at least five times as high as that of the print medium M. In the third embodiment, the resistance of the semiconductive member 41 is selected to be $5\times10^{11}$ $\Omega$.cm.

Operation

The operation of the medium-transporting apparatus of the second embodiment will be described.

Just as in the first embodiment, the print medium M is fed to the attraction region P between the carrier belt 11 and the attraction roller 16. The power supply E1 applies a voltage of about 2 kV across the attraction roller 16 and the idle roller 12, thereby creating a discharge between the attraction roller 16 and carrier belt 11 as the print medium M passes the attraction region P.

The semiconductive member 41 is charged to a positive polarity. Since the semiconductive member 41 is thin, the electric field developed across the thickness of the semiconductive member 41 is very high. Therefore, electrons can easily migrate through the semiconductive member 41 and resilient member 20. Thus, a current flows in directions shown by arrows A from the semiconductive member 41 to the core metal 19 before the charged surface of the attraction roller 16 rotates back to the attraction region P1, thereby neutralizing the surface of the semiconductive member 41.

The discharge continuously occurs between the semiconductive member 41 and the print medium M as the print medium M leaves the attraction region P, so that negative charges Cn are deposited on the print medium M and positive charges Cp are deposited on the semiconductive member 41. Thus, the print medium M is continuously attracted to the carrier belt 11.

If the print medium M has a narrow width, the attraction roller 16 has some areas in direct contact with the carrier belt 11, i.e., areas in which the print medium M is absent between the attraction roller 16 and the carrier belt 11.

FIG. 5 shows an electrical equivalent circuit of the medium-transporting device.

The equivalent circuit is a parallel connection of a series circuit of r11 (carrier belt 11), $r_{MV}$ (print medium M), r41 (semiconductive member 41), and $r_R$ (idle roller 12 plus resilient member 20), and a series circuit of r11 (carrier belt 11), r41 (semiconductive member 41), and $r_R$ (idle roller 12 plus resilient member 20). The components $r_{MV}$ and r41 vary with humidity. Thus, the resistance r41 of the semiconductive member 41 limits the current I2 through areas in which the print medium M is absent between the semiconductive member 41 and carrier belt 11.

The resistance $r_{MV}$ of the print medium M and resistance r41 of the semiconductive member 41 decrease with increasing humidity, and increase with decreasing humidity. Thus, the current flowing through the semiconductive member 41 also restricted in accordance with changes in humidity. When the humidity is high, the current flowing through the semiconductor member 41 increases. As a result, the voltage appearing across the semiconductive member 41 varies in accordance with changes in humidity. The changes in voltage across the semiconductive member 41 allow a stable discharge between the semiconductive member 41 and the print medium M when the print medium M separates from the attraction roller 16 (i.e., leaves the attraction region P1), thereby causing the print medium M to be attracted to the carrier belt 11.

Forming the semiconductive member 41 from, for example, a plastic film enables the attraction roller 16 to be easily cleaned.

While the aforementioned embodiments have been described with respect to a medium-transporting apparatus incorporating a carrier belt 11 therein, the invention may also be applicable to a drum type medium-transporting apparatus where a medium-attracting drum is used in place of the carrier belt and the drum attracts the print medium M thereto.

The medium-transporting device according to the present invention can be used not only for an image-forming apparatus but also for an image reader. The neutralizing member 22 may also be added to the second and third embodiments just as in the first embodiment.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

We claim:

1. A medium-transporting apparatus, comprising:

a transporting member that transports a medium thereon;

an attraction member having a first electrical resistance; and a current preventing member provided on a surface of said attraction member, said current preventing member being in an abutting relation with said transporting member to form an attraction region therebetween and having a thickness less than 0.7 mm and a second electrical resistance higher than the first electrical resistance;

wherein when a voltage is applied to said attraction member and the medium passes the attraction region while the medium is sandwiched between said current preventing member and said transporting member, the medium is electrostatically attracted to said transporting member.

2. The medium-transporting apparatus according to claim 1, wherein said attraction member comprises a core metal and a resilient member formed around the core metal, the resilient member having the first resistance of less than $3\times10^8$ Ω; and wherein said current preventing member is an insulating member provided on a surface of the resilient member.

3. The medium-transporting apparatus according to claim 2 further comprising a neutralizing member disposed to oppose the insulating member, the neutralizing member neutralizing the insulating member.

4. The medium-transporting apparatus according to claim 1 further comprising another attraction member disposed so that said transporting member is sandwiched between said attraction member and said another attraction member.

5. The medium-transporting apparatus according to claim 1, wherein said attraction member comprises a core metal and an electrically conductive member formed around the core metal, the electrically conductive member having the first resistance of less than $3\times10^8$ Ω; and said current preventing member is a semiconductive member provided on the surface of the electrically conductive member, the semiconductive member having a volume resistivity higher than $5\times10^{11}$ Ω.cm.

6. The medium-transporting apparatus according to claim 1, wherein said attraction member comprises a core metal and an electrically conductive member formed around the core metal, the electrically conductive member having the first resistance of less than $3\times10^8$ Ω; and said current preventing member is a semiconductive member provided on the surface of the electrically conductive member, the semiconductive member having ion conduction and a volume resistivity higher than $5\times10^{11}$ Ω.cm.

* * * * *